United States Patent [19]

Hashimoto et al.

[11] 4,269,524

[45] May 26, 1981

[54] MECHANICAL PENCIL

[75] Inventors: Yasuyuki Hashimoto, Nishinomiya; Osamu Torii, Kyoto, both of Japan

[73] Assignee: Ancos Co., Ltd., Osaka, Japan

[21] Appl. No.: 30,803

[22] Filed: Apr. 17, 1979

[30] Foreign Application Priority Data

Apr. 19, 1978 [JP] Japan ..... 53-45330

[51] Int. Cl.[3] ..... B43K 21/16

[52] U.S. Cl. ..... 401/65; 401/67

[58] Field of Search ..... 401/65, 66, 67, 68, 401/74, 79, 85, 89, 92, 93

[56] References Cited

U.S. PATENT DOCUMENTS

| | | | |
|---|---|---|---|
| 3,408,147 | 10/1968 | Blever | 401/65 |
| 3,804,536 | 4/1974 | Torii et al. | 401/65 X |
| 3,914,059 | 10/1975 | Mitsuya | 401/67 |
| 4,172,673 | 10/1979 | Puchein | 401/65 |

*Primary Examiner*—Edward M. Coven

*Attorney, Agent, or Firm*—Sughrue, Rothwell, Mion, Zinn and Macpeak

[57] ABSTRACT

A mechanical pencil having a main hollow body including a first body member and a second body member with a mouth opening at an end and the first body member being rotatable with respect to the second body member and the first and second body members engaged with each other. A slider is retractable from the opening of the main hollow body and has a lead retainer for frictionally gripping lead and a lead case containing extra leads therein is disposed to the rear and is so biased. A lead gripping chuck is connected at the rear end thereof to said lead case and chuck tightening mechanism receives and tightens the chuck and advancing the chuck relative to the mechanism to supply a new lead having a predetermined length from the opening of the slider. The rotational movement of the first body member is transferred to reciprocating movement of the chuck tightening mechanism so that a new lead is supplied from the opening of the main hollow body by the rotation of the first body member.

12 Claims, 13 Drawing Figures

MECHANICAL PENCIL

BACKGROUND OF THE INVENTION

This invention relates to a rotational slide type mechanical pencil in which a slider holding a lead is retractable and extendable in and out of a mouth tip of the mechanical pencil body.

A rotation type of lead feeding mechanical pencil is a well known type of mechanical pencil. However, the rotation lead feeding mechanical pencil has the following disadvantages:

(1) Both hands are required to advance and provide a lead at the mouth end of the mechanical pencil;

(2) An axial body member must be rotated, confirming an extending length of the lead;

(3) A new lead must be inserted from the mouth tip into the mechanical pencil;

(4) Since a lead is liable to be broken in a new lead supply, thin lead is not used.

Due to the above disadvantages, the rotation lead feeding type mechanical pencil is not used as often as in the past. Instead, recently, a step-by-step knocking type mechanical pencil has been successfully introduced. However, the knocking type mechanical pencil has the significant disadvantage that a design thereof deteriorates due to the utilization of a knocking cap. In order to overcome this, a slide cap type mechanical pencil has been provided. However, this slide cap type mechanical pencil has also disadvantage that since a reciprocatingly movable cap per se is moved forward and backward for every knocking, the cap is contacted to the gripping hand and it is difficult to handle it.

On the other hand, the rotation lead feeding type mechanical pencil is still manufactured and used and large companies still make the rotation lead feeding type because of the superiority of its design. Therefore, a rotation type retains an image of first class article.

SUMMARY OF THE INVENTION

The present invention provides a novel mechanical pencil while maintaining a first class article image, to overcome the above described disadvantages inherent to the rotational lead feeding type. Further, a rotation slide type mechanical pencil according to the present invention has an advantage of a knocking type.

Accordingly, it is an object of this invention to provide for an improved mechanical pencil overcoming the difficulties of prior art configurations.

It is another object of this invention to provide for an improved mechanical pencil that is durable and automatically advances a predetermined length of lead.

Yet another object of this invention is to provide for a mechanical pencil where the lead is advanced by rotation of the rear body so that the lead is supplied from the mouth opening.

These and other objects of this invention are accomplished by a mechanical pencil having a main hollow body including a first body member and a second body member with a mouth opening at an end and the first body member being rotatable with respect to the second body member and the first and second body members being engaged with each other. A slider is retractable from the opening of the main hollow body and has a lead retainer for frictionally gripping the lead and a lead case containing extra leads therein is disposed rearwardly and is biased.

A lead gripping chuck is connected at the rear end thereof to the lead case and a chuck tightening mechanism is employed for receiving and tightening the chuck and for advancing the chuck relative to the mechanism to supply a new lead having a predetermined length from the opening of the slider. The rotational movement of the first body member is transferred to reciprocating movement of the chuck tightening mechanism, so that a new lead is supplied from the opening of the main hollow body by the rotation of the first body member.

DESCRIPTION OF THE PREFERRED EMBODIMENTS

Figure 1:
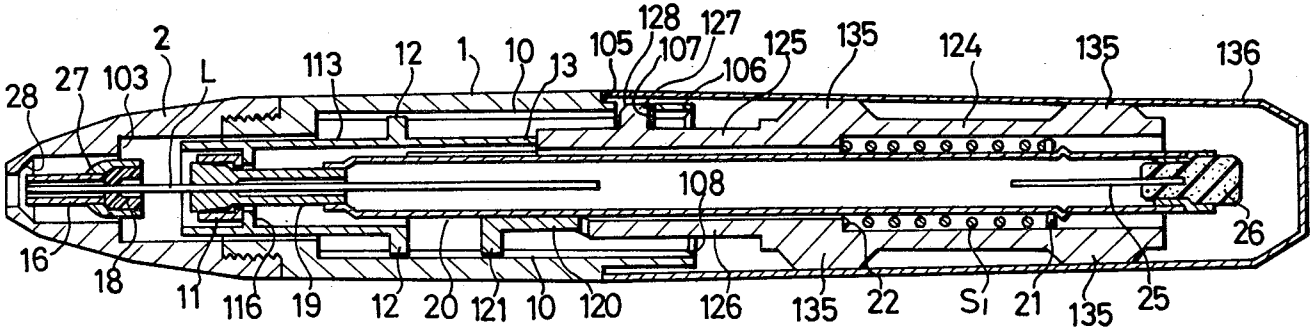
FIGS. 1, 3, 4 and 5 show longitudinal sectional views of the first embodiment according to the present invention.

Referring now to FIG. 1, a first embodiment of the present invention, a mechanical pencil is shown in the retracting state. A lead is designated by L. A shouldered portion 103 is formed in an inner surface of the mouth member 2. A shouldered portion 105 is formed in the rear outer end portion of the front body 1. At the same time a small outer diameter portion 106 is formed integrally with the shouldered portion 105. A radial hole 107 is formed in the small outer diameter portion 106. A slant or beveled surface 108 is formed at the rearmost end of the front body 1. A slider 16 and a lead retainer 18 are positioned inside a mouth member 2.

A tightening member receiver 113 is disposed within the front body 1 and the mouth member 2. Projections 12, formed in the rear peripheral portion of the tightening member receiver 113 are slidably engaged with guide grooves 10, formed in the front body 1. An extending rod 13 extends from the tightening member receiver 113. An annular projection 116 is formed in a front inner surface of the receiver 113. A tightening member 11 is disposed in front of the annular projection 116 of the receiver. A chuck 19 is disposed within the tightening member 11. The rear end of the chuck 19 is coupled to a lead case 20. The lead case 20 extends from the inner portion of the receiver 113 rearward. The lead case has a tapered forward portion to channel lead into the chuck 19. A receiving member 120 is integrally secured to the outer periphery of the lead case 20. A projection 121 is formed on the receiving member 120 and engaged with the guide groove 10. For this reason, the chuck 19 and the lead case are longitudinally movable but cannot be rotated.

Figure 2:
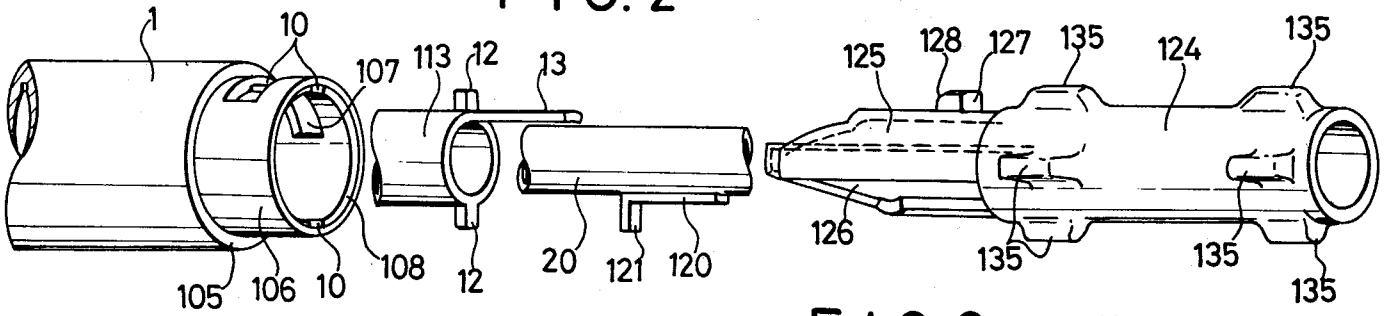
FIG. 2 shows a perspective view of a disassembled primary part of the first embodiment.

A rotary cylinder 124 is provided around the periphery of the lead case 20 to the rear of the tightening member receiver 113. As best shown in FIG. 2, a pair of extension rods 125 and 126 are secured to the front end of the rotary cylinder 124. A projection 127 is formed on the outer surface of the extension rod 125. A slant surface 128 is formed at the front end of the projection 127. As the interval between the two extension rods is decreased, the extension rods 125 and 126 are inserted from the rear side of the front body 1 into the front body 1 so that the projection 127 of the extension rod 125 is engaged with the radial hole 107. Accordingly, the rotary cylinder can be rotated but cannot be moved longitudinally. The slant surface 108 of the front body 1 and the slant surface 128 of the projection 127 of the extension rod 125 serve to facilitate to engage the projection 127 with the radial hole 107.

Figure 6A:
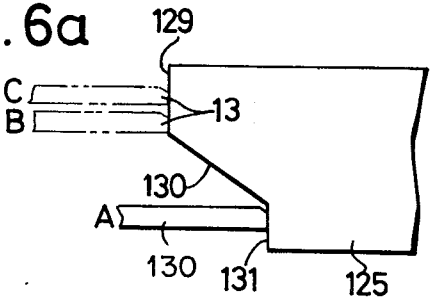
FIGS. 6(*a*) and (*b*) show developed views of a primary part of the first embodiment.
Figure 6B:
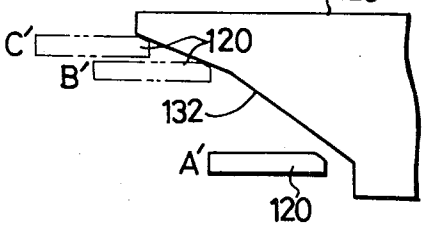

As shown in FIG. 2, cam surfaces are formed at the front ends of the extension rods 125 and 126. FIGS. 6(*a*) and (*b*) show exploded views illustrating the relations between the extending rod 13, receiving member 120, and the extension rods 125 and 126, respectively. The cam surface of the extension rod 125 is composed of a first plane surface 129, a slant surface 130 and a second plane surface 131, successively. The cam surface of the extension rod 126 is composed of substantially straight slant surface. In assembly, the extending rod 13 of the tightening member receiver 113 abuts with the cam surface of the extension rod 125 while the receiving member 120 for the lead case 20 abuts with the cam surface of the extension rod 126.

The rotary cylinder 124 is provided with a spring $S_1$ as shown in FIG. 1. The spring $S_1$ is disposed between a shouldered portion 22 formed in the rotary cylinder 124 and a ring 21 secured on the lead case 20 to thereby urge the lead case 20 to be moved backward. A plurality of convex portions 135 are formed on the outer periphery of the rotary cylinder and frictionally engage a cap 136 which abuts with the shouldered portion 105 of the front body.

In FIG. 1, the tightening member receiver 113, the chuck 19, the lead case 20 are shown positioned at the rearmost position. The chuck 19 received in the tightening member 11 clamps the lead. The extending rod 13 of the tightening member receiver 113 is positioned at A shown in FIG. 6(*a*), with the rear end of the rod 13 abutting the second plane surface 131 of the cam surface of the extension rod 125. The extending rod 13 is prevented from moving in the rearward direction. On the other hand, the receiving member 120 on the lead case 20 is also positioned at A' shown in FIG. 6(*b*). However, the receiving member does not abut with the extension rod 126. Due to a spring force of the spring $S_1$, the chuck 19 is clamped by the tightening member 11. At this time, the slider 16 attached to the lead is also retracted into the mouth member 2.

Figure 3:
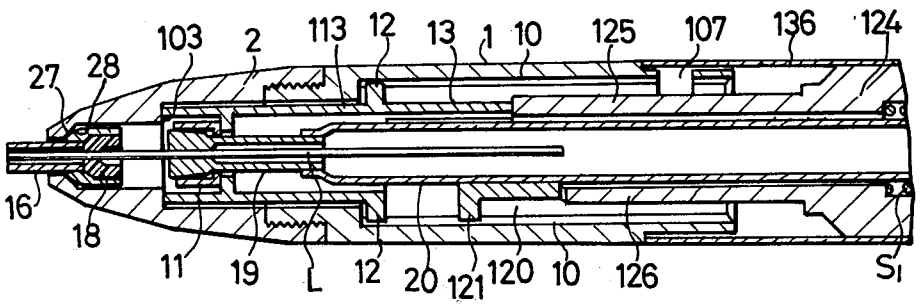
Figure 4:
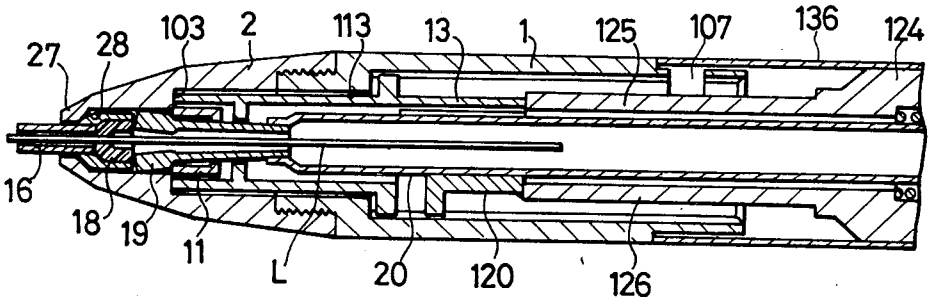

In a state shown in FIG. 1, when the cap 136 is rotated, the tightening member receiver 113 is advanced and stopped at the shouldered portion 103 of the mouth member 2 and the rear end of the receiver 113 is slid on the first plane surface 129. On the other hand, the receiving member 120 is pushed by the slant surface 132 of the extension rod 126 to advance the lead case 20. The chuck 19 is advanced together with the tightening member 11. Then, after the tightening member 11 is prevented from advancing by the shouldered portion 103 of the mouth member 2, only the chuck 19 is advanced. When the tightening member 11 releases the chuck 19, the lead is also released. Thereafter, only the chuck 19 is advanced in abutment with the slider 16. Accordingly, a new lead having a length corresponding to the moving distance of the tightening member 11 from the position in FIG. 3 to the position in FIG. 4 is supplied from the opening of the slider 16. The mechanical pencil in this state is shown in FIG. 4. With respect to FIGS. 6(*a*) and (*b*), the extending rod 13 and the receiving member 120 are moved to the positions designated by C and C', respectively.

Figure 5:
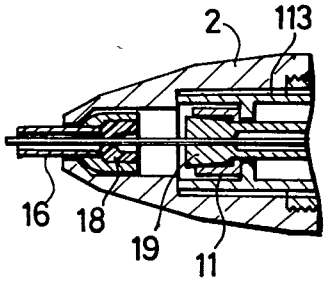

Next, when the gripping force applied to the cap 136 is released, the chuck 19 and the lead case 20 are drawn by the spring $S_1$, and the chuck 19 is engaged with the tightening member 11 so that the lead is again grasped by the chuck for writing. At this time, the receiving member 120 slides on the slant surface 132 of the extension rod 126 and is moved backward. As a result, while the rotary cylinder 124 is rotated in the opposite direction, the receiving member 120 is stable at the position B' in FIG. 6(*b*). The writing condition is shown in FIG. 5. The slider 16 is slightly moved backward for a short time until the the lead is grasped by the chuck. A new lead from the front end of the slider 16, having a predetermined length, is supplied.

If the cap 136 is fully rotated and then the grasping force is released, the slider is advanced to the foremost position and additionally a new lead having a predetermined length from the front end of the slider 16 is supplied for writing. As mentioned in the preceding embodiment, if the slider end is at the same level as that of the lead end (as shown in FIG. 3), it is difficult to obtain a good writing feeling in the initial writing since the slider 16 directly touches the paper surface to generate undesirable writing resistance. On the contrary, if the slider 16 is displaced to the lead end as shown in FIG. 5, a good initial writing is obtained.

FIG. 1 shows a mechanical pencil wherein the slider 16 is most advanced in the slider retracting state within the mouth member 2. In this state, if the cap 136 is rotated, the state shown in FIG. 3 results. Thereafter, the cap 136 is further rotated to thereby provide a new lead from the slider 16, having a length corresponding to the advancing distance of the tightening member 11 since the shouldered portion 27 of the slider abuts to the shouldered portion 28 of the mouth member 2 as shown in FIG. 3. If the lead is worn down to some extent and the slider 16 is retracted, as it is, into the mouth member 2, by the rotation of the cap 136 in the lead feeding direction, the slider 16 is advanced together with the lead corresponding to the advance the tightening member 11. Accordingly, a new lead is not supplied from the opening of the slider 16. Also, in this case, though the chuck 19 pushes the slider 16, the operation in which the predetermined length lead is provided from the slider end is not carried out. If desired, that the predetermined length lead be provided from the opening of the slider 16, the grasping force applied to the cap 136 is once released to thereby bring the mechanical pencil into a state shown in FIG. 3 and, thereafter, the cap is again rotated in the lead feeding direction to thereby bring the pencil into a state shown in FIG. 5.

Writing with the pencil is carried out in the state shown in FIG. 5 and the slider 16 is moved backward by the contact of the paper surface as the lead is abraded or worn out gradually. Therefore, without any additional operation, until the slider 16 is fully retracted into the pencil body, the user can continue writing. Since the lead is protected by the slider 16, the lead is not broken.

When the slider 16 is moved backward to some extent due to continuous writing and the cap 136 is rotated by the user, the lead case 20 is advanced to thereby push the slider 16 by action of the chuck 19. In this case, when the grasping force is weakened, the chuck 19 is moved backward whereby the lead is again grasped by the chuck 19. This is a suitable writing condition. If the cap 136 is rotated in the lead supply direction, the chuck 19 can push the slider 16. In order to supply a new lead from the slider end, the grasping force is once weakened and thereafter the cap 136 is rotated.

For example, in the case where writing is carried out on soft paper, that is, the use of the slider is undesired, it is sufficient to slightly rotate and release the cap 136 to supply only a new lead. As is clear from the above, step-by-step feeding of a new lead as in the knocking type is possible.

When writing is finished, the cap 136 is rotated in the opposite direction. As a result, the resistance force against the tightening member 113 is eliminated. The spring force of the spring $S_1$ urges the tightening member 113 and the lead case 20 to be moved rearward. At the same time, the slider 16 and the lead are moved rearward to the position shown in FIG. 1.

As described above, in the first embodiment, since the lead is grasped by the chuck 19 in the retracting state, there is a possibility that the lead may be broken by an impulse during carrying. Further, there is a possibility that the lead having a predetermined length is not sufficiently supplied by one operation. The second embodiment shown in FIGS. 7 to 10 can overcome these deficiencies.

Figure 7:
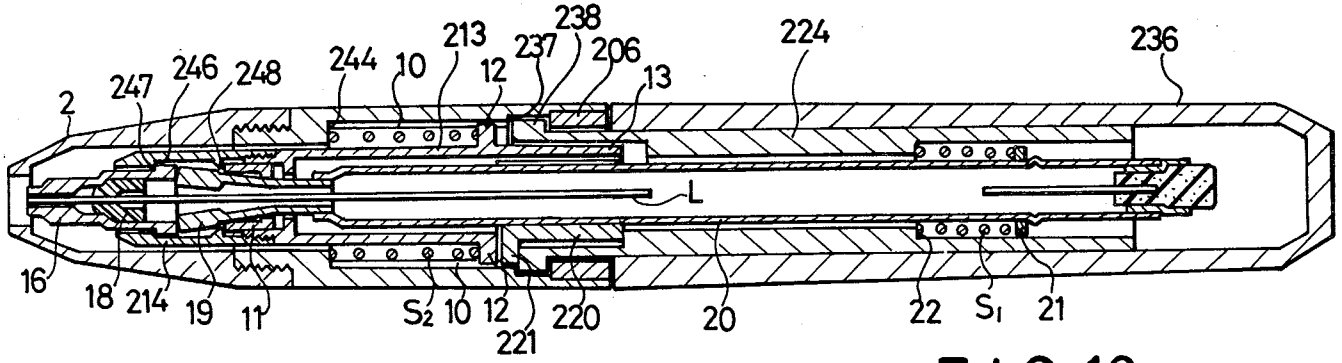
FIGS. 7 to 9 show longitudinal sectional views of the second embodiment according to the present invention.
Figure 10:
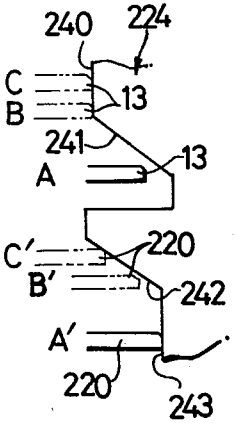
FIG. 10 shows a developed view of the primary part of the second embodiment.

FIG. 7 shows a mechanical pencil in a retracting condition. In this embodiment, a shouldered portion formed in an inner rear end portion of a front axial body 1 abuts to a front end of a rotary cylinder 224. A flange 238 is formed at the front end of the rotary cylinder 224. A stopper ring 206 is fixedly inserted into the rear end portion of the front body 1 to receive the rotary cylinder 224 at the flanged portion 238. The rotary cylinder 224 is also fixedly inserted directly into a cap 236 without any projections. A cam surface is formed in the inner front end portion of the rotary cylinder 224 as shown in FIG. 7. An exploded view of the cam portion of the rotary cylinder 224 is shown in FIG. 10. The cam surface is formed with a first plane surface 240, a first slant surface 241, adjacent to the first plane surface 240, a second slant surface 242 and a second plane surface 243 adjacent to the second slant surface 242.

A spring $S_2$ is disposed between a shouldered portion 244 formed in the front body 1 and projections 12 extending from a tightening member receiver 213 to thereby urge the tightening member receiver 213 to be moved rearward. An inner sleeve 214 is threadedly engaged with the front end portion of the tightening member receiver 213. A slider 16 is partially disposed within the inner sleeve 214 so that the front end of the slider 16 can be projected from the front opening of the inner sleeve 214. A shouldered portion 246 is formed in a front portion of the inner sleeve 214 while a shouldered portion 247 is formed in an outer rear portion of the slider 16. Hence, the shouldered portion 247 of the slider 16 abuts with the shouldered portion 246 of the inner sleeve 214 and the slider 16 is prevented from advancing from the inner sleeve 214. A radially inward projected portion 248 is formed in an inner rear portion of the inner cylinder 214 so that the slider 16 cannot be drawn off and the tightening member 11 cannot be advanced from the projected portion 248.

The same construction and mechanism in the first embodiment for the remaining elements are used in this embodiment except for the construction mentioned above.

As shown in FIG. 7, in the retracting state of the mechanical pencil, the rear end of the receiving member 220 abuts with the second plane surface 243 of the cam surface while the extending rod 13 does not abut with the cam surface. Therefore, the tightening member receiver 213 is urged to be moved backward by spring $S_2$. As a result, the chuck does not grip the lead, being disengaged from the tightening member 11. In this state, the extending rod 13 and the receiving member 220 are positioned at A and A′ shown in FIG. 10.

Figure 8:
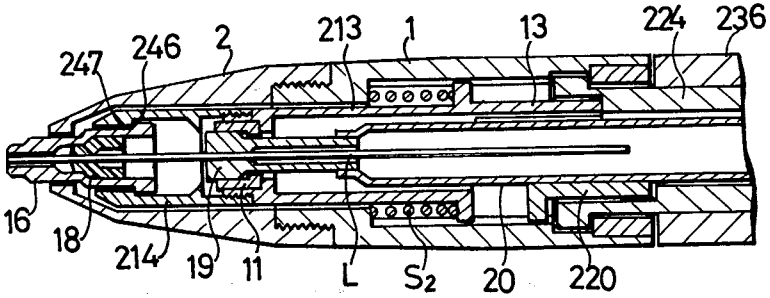

In the state shown in FIG. 7, when the cap 236 is rotated, the first slant surface 241 pushes the extending rod 13, the tightening member receiver 213 is advanced. The chuck 19 is engaged with the tightening member 11 and the mechanical pencil is shown in FIG. 8. The rear end of the extending rod 13 is in abutment with the first plane surface 240. The extending rod 13 and the receiving member 220 are positioned at B and B′ shown in FIG. 10.

When the cap 236 is further rotated, the tightening member receiver 11 is stopped, and the slider 16 is also stopped by the abutment between the shouldered portion 247 thereof and the shouldered portion 246 of the inner sleeve 245. However, the receiving member 220 is pushed by the second slant surface 242 so that only the lead case 20 is advanced to thereby release the lead by the chuck disengaged from the tightening member 11. In this case, the lead having a length corresponding to the advance of the tightening member is supplied from the end opening of the slider 16. Then, by further rotation, the mechanical pencil assumes the state shown in FIG. 9. At this time, the extending rod 13 and the receiving member 220 are positioned at C and C′ shown in FIG. 10.

Figure 9:
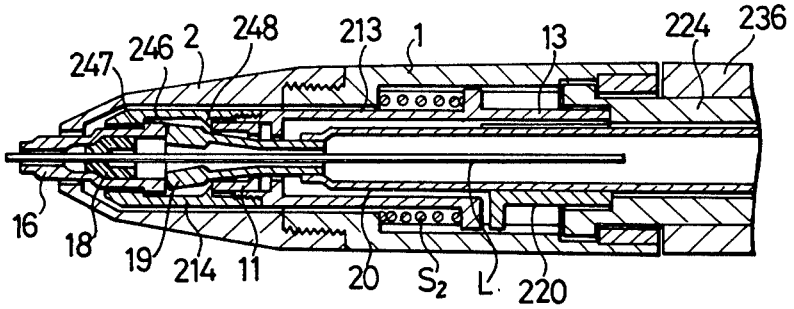

When the gripping force of cap 236 is weakened in the state shown in FIG. 9, the lead case 20 or the like is slightly moved backward to provide a writing condition wherein the lead is grasped by the chuck 19 in the same manner as the first embodiment.

In the second embodiment, the operation to advance the lead and the slider 16 from the slightly retracted condition is carried out in the same manner as in the first embodiment. However, when the full retracting position is transferred directly to the writing position, as different from the first embodiment, a new lead having a predetermined length is always provided from the slider end since in the second embodiment the front ends of the opened chuck 19 always contacts the rear end of the slider 16 in the full retracting position as shown in FIG. 7. In the first embodiment, a new lead having a predetermined length is provided from the slider end if the state shown in FIG. 1 in which the lead is not worn out after lead is provided from the slider end is directly transferred to a writing condition. However, in the first embodiment, a lead having a predetermined length from the front end of the slider 16 is not supplied therefrom if the lead is worn out to thereby retract the slider backward.

In case where the mechanical pencil is varied from a state where the slider is furthermost advanced in the writing condition to a state where the slider 16 is fully retracted for carrying and non-use, when the state of FIG. 8 is transferred to the state of FIG. 7, since the tightening member receiver 213, the inner cylinder 214, the slider 16 are moved further backward after the chuck 19 is stopped, a new lead is provided from the slider end by a length corresponding to the backward movement of the slider 16. This occurs as long as the lead grasped by the chuck 19 is stopped, that is, during a time period from the time when the projection 248 is in abutment with the front end of the tightening member 11 to the time when the chuck 19 is disengaged from the tightening member 11.

Figure 11:
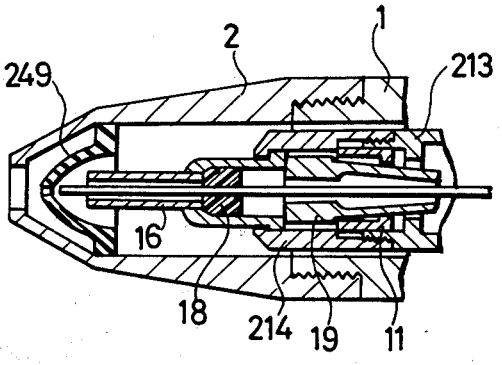
FIG. 11 shows a cross-sectional view of a primary part of the third embodiment according to the present invention.

FIG. 11 shows a third embodiment according to the present invention. In this embodiment, a retainer 249 is provided in an inner front portion of the mouth member 2. The retainer 249 is made of elastic materials such as a rubber and a leaf spring, having a small hole formed in the middle thereof. When, by the rotation of the cap 236, the tightening member receiver 213 is advanced, the lead and the slider 16 are not advanced by the retainer 249. When the chuck 19 is advanced by the further rotation of the cap 236, the slider 16 is also advanced in contact with the chuck 19. At this time, the lead is not advanced by the retainer 249 and inserted into the slider 16. Accordingly, even when the lead excessively protrudes from the slider end in the retracting condition, in the writing condition, a new lead having a predetermined length is provided from the slider end.

Figure 12:
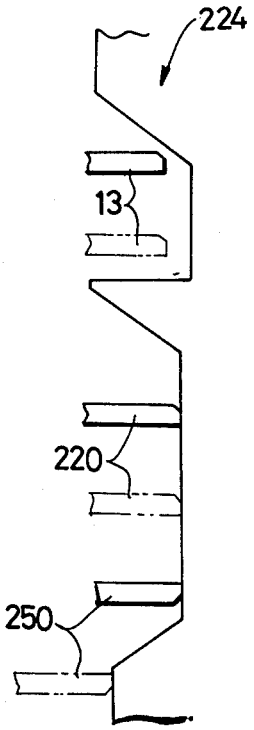
FIG. 12 shows a primary part of the fourth embodiment according to the present invention.

FIG. 12 shows a fourth embodiment of the present invention. An inner construction according to the present invention allows other writing means such as a ball-point pen to be disposed in the mechanical pencil body and the cam surface of the rotary cylinder is formed as shown in FIG. 12 to thereby provide a multi-writing pen. Reference numeral 250 designates an extending rod for a ball-point pen. By the rotation of the cap 236 in the retracting direction, the means for the mechanical pencil is retracted in the same manner as the second embodiment and by the further rotation in the direction, a second writing means such as a ball-point pen is provided for writing.

As mentioned above, various embodiments according to the present invention have been shown. However, the spirit and scope according to the present invention are not limited to the specific embodiments. For example, though in the first specific embodiment, the tightening member receiver 113, the lead case 20, the extending rod 13, the receiving member 120 and the like are provided and the cam surface is on the rotary cylinder side, the cam surface may be formed on the side of the tightening member receiver or the lead case while the projection or the like for moving along the cam surface may be formed on the rotary cylinder. Many various modifications of the cam position and the cam construction can be considered within the scope of the present invention. In a rotation lead feeding mechanical pencil according to the present invention, although the main body is divided into front and rear bodies and rear body can be rotated, it is sufficient to provide a construction wherein either body can be rotated to move the lead case and the tightening member receiver 213 appropriately. As mentioned in the preceding embodiment, a spiral groove is also included in the scope of the present invention.

In the preceding embodiments, when the chuck 19 is advanced, the tightening member 11 is engaged with the chuck 19 while clamping the lead and advanced by a short distance. However, if the tightening member 11 is formed integrally with the tightening member receiver 213, immediately after the chuck 19 is advanced the clamping force to the lead is released resulting in the same effect. In this case, although a new lead is not provided from the slider end, it is possible to obtain an effect of the slider itself, that is, an effect that the lead is not easily broken. The slider 16 is gradually moved backward as writing.

In the first embodiment, if in a writing condition a short interval is maintained between the front end of the tightening member receiver 213 and the shouldered portion 103 of the mouth member 2 even in the case where the tightening member 11 and the receiver 213 are integral, when the chuck 19 is advanced, the tightening member 11 and the receiver 213, while engaged with the chuck 19, can be advanced by a short distance. Therefore, a new lead is provided from the slider end.

In the second embodiment, instead of the slider, a pipe and a lead retainer can be used in the front end of the tightening member receiver 213. In this case, since a new lead must be supplied from the tip during writing, it is necessary that the tightening member 11 be advanced together with the chuck 19 a short distance.

In the fourth embodiment, multi-writing means of a mechanical pencil and a ball-point pen are described. However, it is possible to provide multi-writing means such as in a multi color mechanical pencil by providing two mechanical pencils of the fourth embodiment to reverse the directions of the cam surface.

As is clear from the above, the present invention relates to a rotation lead advancing type mechanical pencil. However, a mechanism for a step-by-step knocking type mechanical pencil rather for a rotational one is adopted for the present invention. Therefore, the present invention will provide the following advantages:

(1) An external image of the rotational mechanical pencil results;

(2) Not only a new lead can be advanced together with the slider, but a lead having a predetermined length from the opening of the slider can be supplied;

(3) A new lead can be automatically supplied from the lead case;

(4) An improved design of a mechanical pencil may be carried out since the knocking head is unnecessary; and (5) Accidental lead breakage can be prevented if the lead is not clamped by the chuck in non-use and carrying thereof.

It is apparent that other modifications and changes may be made without departing from the essential concepts of this invention.

What is claimed is:

1. A mechanical pencil comprising:

a main hollow body including a first body member and a second body member, said hollow body having a mouth opening at an end thereof, said first body member being rotatable with respect to said second body member and said first and second body members engaging each other, a slider retractable in said opening of the main hollow body, said slider having a lead retainer for frictionally gripping lead and an opening at one end thereof, a lead case within said main hollow body, containing extra leads therein, first biasing means for biasing said lead case in a direction away from said mouth opening, a lead gripping chuck connected at the front end of said lead case, a chuck tightening mechanism for receiving and tightening said chuck and for advancing the chuck, said chuck tightening mechanism positioned around said lead gripping chuck and advancing with said chuck to supply a new lead having a predetermined length from the opening in one end of the slider, first transferring means for transferring the rotational movement of said first body member to reciprocating movement of said chuck tightening mechanism only when said first body member is rotated in one direction, and second transferring means for transferring the rotational movement of said first body member to reciprocating movement of said lead case, whereby a new lead is supplied from the opening of the main hollow body by advancement of said chuck as a result of the rotation of the first body member.

2. A mechanical pencil as claimed in claim 1, wherein said chuck tightening mechanism comprises a hollow body member biased to be moved backward, a chuck tightening member axially disposed around said chuck for tightening said chuck and a cam contact extending member extending from said hollow body member.

3. A mechanical pencil as claimed in claim 2, further comprising means for moving said chuck tightening member relatively within the chuck tightening mechanism.

4. A mechanical pencil as claimed in claim 2, further comprising second biasing means for biasing said hollow body member to be moved backward.

5. A mechanical pencil as claimed in claims 2 or 3, further comprising an abutting portion formed in the second body member for stopping said slider, whereby a new lead is supplied from the opening in one end of the slider when the first body is rotated and the chuck is tightened by said chuck tightening member.

6. A mechanical pencil as claimed in claims 2 or 3, further comprising an abutting portion formed in the hollow body member of said chuck tightening mechanism for stopping said slider, whereby a new lead is supplied from the opening in one end of the slider when the first body is rotated and the chuck is tightened by said chuck tightening member.

7. A mechanical pencil as claimed in claim 6, further comprising means for retracting the lead to the end of the slider, said means for retracting the lead provided adjacent the opening of said main hollow body.

8. A mechanical pencil as claimed in claims 2 or 3, further comprising a first cam surface formed in the first body member, said first cam surface being positioned to push said cam contact extending member.

9. A mechanical pencil as claimed in claim 8, further comprising second biasing means for biasing said hollow body member to be moved backward.

10. A mechanical pencil as claimed in claim 9, further comprising a second cam surface formed in the first body member, said second cam surface being positioned to push said lead case against said second biasing means, whereby said lead case is advanced in abutment with said second cam surface when the first and second body members are relatively rotated to each other.

11. A mechanical pencil as claimed in claim 8, further comprising a second cam surface formed in the first body member, said second cam surface being positioned to push said lead case against said first biasing means, whereby said lead case is advanced in abutment with said second cam surface when the first and second body members are relatively rotated to each other.

12. A mechanical pencil as claimed in claims 1, 2, 3, or 7, wherein said first and second body members are positioned on the rear side and on the front side of the mechanical pencil, respectively.

* * * * *